United States Patent [19]

Reuter

[11] Patent Number: 4,482,000

[45] Date of Patent: Nov. 13, 1984

[54] VARIABLE-PERMEABILITY PATTERN COATING FOR LOST FOAM CASTING

[75] Inventor: Reinhold J. Reuter, Warren, Mich.

[73] Assignee: General Motors Corporation, Detroit, Mich.

[21] Appl. No.: 402,129

[22] Filed: Jul. 26, 1982

[51] Int. Cl.[3] ..... B22C 9/02

[52] U.S. Cl. ..... 164/34; 164/45; 164/249

[58] Field of Search ..... 164/45, 34, 249

[56] References Cited

U.S. PATENT DOCUMENTS

| | | | |
|---|---|---|---|
| 3,169,288 | 2/1965 | Dewey . | |
| 3,314,116 | 4/1967 | Wittmoser et al. . | |
| 3,339,620 | 9/1967 | Kryyzanowski et al. . | |
| 3,410,942 | 11/1968 | Bayer | 164/34 X |
| 3,498,360 | 3/1970 | Wittmoser et al. | 164/34 X |
| 4,010,791 | 3/1977 | Hetke et al. | 164/34 |

*Primary Examiner*—Howard N. Goldberg
*Assistant Examiner*—Timothy V. Eley
*Attorney, Agent, or Firm*—Douglas D. Fekete

[57] ABSTRACT

A vaporizable pattern for casting reduced porosity metal by a lost foam process is coated with a thermally insulative, predominantly refractory particulate layer comprising polymeric particles. During metal casting, the refractory particles insulate the polymeric particles to delay vaporization, whereupon pattern decomposition vapors build up and slow metal replacement of the pattern to reduce vapor-entrapping turbulence. Subsequent vaporization of the polymeric particles produces pores in the residual refractory coating wherethrough pattern decomposition vapors readily vent to avoid entrapment in the metal.

6 Claims, 4 Drawing Figures

VARIABLE-PERMEABILITY PATTERN COATING FOR LOST FOAM CASTING

BACKGROUND OF THE INVENTION

This invention relates to a coating applied to a polystyrene pattern for casting metal by a lost foam process. More particularly, this invention relates to a pattern coating applied in a single application and initially having a low permeability to pattern decomposition vapors, but thereafter developing a high permeability, which variable permeability reduces turbulence in metal replacing the pattern, while ultimately venting the vapors, to reduce gas entrapment within the metal and thereby reduce porosity in the product casting.

In copending U.S. patent application Ser. No. 402,108 filed 7/26/82 now U.S. Pat. No. 4,448,235, a lost foam metal casting process is described wherein the polystyrene pattern is coated first with a thermally insulative, relatively gas permeable, refractory layer and thereafter with a vaporizable, relatively gas impermeable, polymeric layer. The refractory layer is applied as a water-base slurry and the polymeric layer as a water-base emulsion. During casting, the refractory layer insulates the polymeric layer to delay vaporization. Because of the low permeability of the polymeric layer, pattern decomposition vapors build up and slow the flow of metal replacing the pattern, thereby reducing vapor-entrapping turbulence in the metal. The polymeric layer eventually vaporizes, leaving the permeable refractory layer, wherethrough pattern decomposition vapors readily vent, thereby avoiding entrapment within the advancing metal. Thus, the two-layer coating produces a desired sequence of low and high permeability that reduces metal turbulence, while ultimately venting vapors, both of which reduce porosity in the cast metal. Although the dual coating has been generally satisfactory for reducing porosity, the two separate coating operations substantially double the required equipment, time and costs. Also, because both coats are water-base, the second coat must be carefully applied to minimize disruption of the first. Although it is desired to eliminate a second coating operation, mixtures of refractory slurry and polymer emulsion have been generally unacceptable, in part because flocculation prevents a suitable coating from being applied.

Therefore, it is an object of this invention to provide a single coating for a vaporizable pattern for lost foam casting of metal, which coating is adapted to sequentially display a relatively low vapor permeability and thereafter a relatively high vapor permeability to cause pattern decomposition vapors to initially build up, but thereafter to vent through the coating, thereby reducing turbulence in the metal, while ultimately venting the vapors, to reduce vapor entrapment in the metal replacing the pattern and thereby to reduce porosity in the casting.

It is a further object of this invention to provide an improved variable permeability, thermally insulative coating suitable for a vaporizable lost foam casting pattern, which coating is adapted to be applied in a single operation to reduce the time, equipment, handling problems and costs associated with multicoat, variable permeability coatings. The coating comprises vaporizable polymeric particles dispersed within a thermally insulative, refractory matrix and is adapted to initially cause pattern decomposition vapors to build up and slow pattern replacement by metal to reduce gas-entrapping turbulence. Thereafter, the polymeric particles vaporize, creating pores in the coating wherethrough vapors escape to avoid entrapment in the metal. Thus, the single coating reduces vapor entrapment to reduce porosity in the cast metal.

BRIEF SUMMARY OF THE INVENTION

In a preferred embodiment, these and other objects are accomplished by coating a vaporizable polystyrene pattern suitable for lost foam metal casting with a predominantly refractory particulate layer comprising interstitial polymeric particles. The polymer is water insoluble and is vaporizable at metal casting temperatures. The layer is applied in the form of a water-base slurry containing refractory particles and the polymeric particles. Thus, both refractory and polymeric particles are suitably applied in a single coating operation.

During casting, the coated pattern is embedded in a lake sand mold and molten metal is poured onto the pattern such that the metal progressively consumes and replaces the pattern, vaporizing the polystyrene. The predominantly refractory layer forms a thermally insulative barrier about the pattern suitable for preventing premature melt solidification. The refractory particles also thermally insulate the dispersed polymeric particles from heat radiated from the molten metal to delay their vaporization. With the polymeric particles, the layer retards outflow of polystyrene decomposition vapors, thereby causing the vapors to build up ahead of the metal. This buildup of vapors is enhanced by any liquification of the polymer that occurs as the layer is heated. The vapor build up slows the metal flow to replace the pattern and thereby reduces turbulence. After a suitable delay, the polymeric particles vaporize, thereby producing interstitial pores in the layer, through which pattern decomposition vapors readily vent into the sand mold to avoid entrapment in the metal. Thus, the coating produces a desired sequence of low and high permeability that not only reduces gas-entrapping turbulence, but also vents substantially all vapors, to permit pattern replacement without vapor entrapment and thereby reduce porosity in the cast metal.

DETAILED DESCRIPTION OF THE INVENTION

Figure 1:
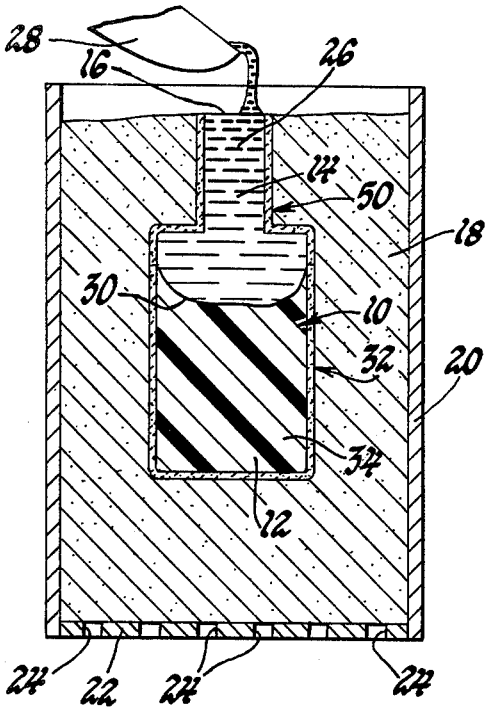
FIG. 1 is a cross sectional view showing a lost foam casting pattern bearing a variable-permeability, unitary coating of this invention and in the process of being consumed during casting.

Referring to FIG. 1, in a preferred embodiment, a uniformly coated, low density polystyrene pattern 10 is provided for forming an aluminum alloy casting. Pattern 10 comprises a product portion 12 suitably sized and shaped to produce a desired product casting. Pattern 10 also comprises a downsprue portion 14 having an uncoated surface 16 and communicating with product portion 12 for admitting and conveying melt to replace the product portion 12. The pattern is formed by injecting preexpanded polystyrene beads into a cavity defined within a steam chest and forcing steam therethrough to fuse the beads into the pattern.

For casting, pattern 10 is embedded in a mold 18 formed of dry, unbonded sand, such as lake sand. Mold 18 is contained in a flask 20 comprising a bottom wall 22 having perforations 24 through which air is injected to fluidize mold 18 for embedding pattern 10 and removing the product casting. Pattern 10 is embedded in mold 18 such that product portion 12 is fully submerged and metal-admitting surface 16 lies above mold 18.

During casting, molten aluminum alloy 26 is poured from a ladle 28 onto pattern surface 16. Heat from melt 26 vaporizes adjacent polystyrene, whereupon melt flows into the space vacated by the vaporized polystyrene, thereby exposing the melt to additional polystyrene for vaporization. Thus, molten aluminum 26 progressively destroys pattern 10 and concurrently duplicates its shape to form the casting. This progressive vaporization and flow occurs along a melt front 30. Front 30 travels along downsprue 14 and thereafter through product portion 12.

In accordance with this invention, pattern 10 carries a single, uniform coating 32 prior to casting. Coating 32 preferably comprises, by weight, about 61 parts silicon dioxide (silica), 2 parts attapulgite clay, 5.5 parts bentonite clay, 4 parts muskovite (mica), 15.5 parts kaolin clay, 13 parts particulate polyethylene, 0.5 parts zanthan gum and 4 parts calcium lignosulfonate binder. The refractory materials, particularly the silica and the kaolin, are a mixture of distinct water-insoluble particles. The preferred coating is prepared from a water-containing cake of a type typically employed for formulating core wash and commercially available from C. E. Cast Products, Ohio, under the trade designation Arcoate 108. To 100 parts by weight commercial cake is added about 13 parts kaolin clay. Also, 13 parts particulate polyethylene are added. A preferred polyethylene is a water-insoluble fine powder commercially available from Arco Chemical Company under a trade grade designation SDP-750. The predominantly particulate materials are suitably blended and sufficient water is added to form a uniform slurry having a specific gravity of about 35° Baumé'.

Coating 32 is applied by temporarily immersing pattern 10 into the refractory-polymer slurry. Excess slurry is drained off, and the residual is hot air dried at about 43° C. to form the coating. The coating weight is about 0.088 gram per square centimeter. The coating is very thin, typically being on the order of about 50 microns thick.

Figure 2:
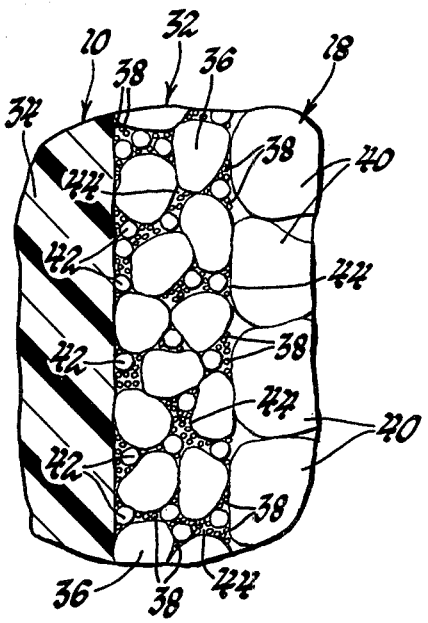
FIG. 2 is an enlarged cross-sectional view of a portion of the pattern in FIG. 1 showing the unitary coating prior to casting.
Figure 3:
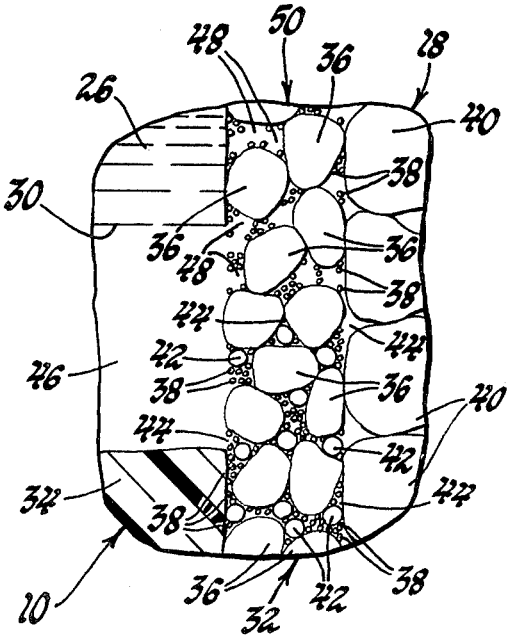
FIG. 3 is an enlarged view similar to FIG. 2 showing the coating during casting as the adjacent pattern is being vaporized and replaced by melt.
Figure 4:
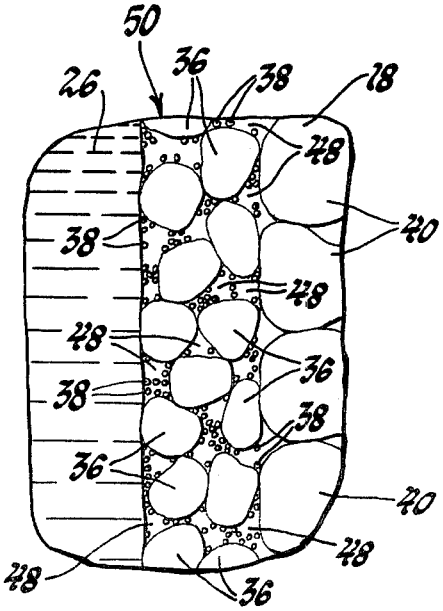
FIG. 4 is an enlarged view similar to FIGS. 2 and 3 and showing the residual coating adjacent the metal after casting.

The nature of coating 32 is better understood by reference to FIGS. 2 through 4, which figures are intended for illustration and not as accurate depictions. Coat 32 is applied onto a polystyrene base 34 that forms the basis of pattern 10. The coating is formed of a predominantly refractory particulate matrix comprising relatively large, irregularly shaped particles 36, believed to be principally silica, and relatively fine, irregularly shaped particles 38, believed to be principally kaolin and finer silica, bonded together, principally by the lignosulfonate compound. Even the relatively large particles 38 are substantially smaller than sand particles 40 that form mold 18, the ratio of maximum cross-sectional dimensions being about 1 to 2.5. In comparison, particles 36 are about 100 times greater in cross-sectional dimension than particles 38. The matrix also includes polyethylene spheres 42. The diameters of spheres 42 are about 20 times smaller than the maximum cross-sectional dimensions of particles 36. Polyethylene spheres 42 are generally lower in density than refractory particles 36 and 38. Thus, spheres 42 make up a greater volume proportion of the coating than is indicated by the weight proportion. It is estimated that the matrix is approximately 30 parts by volume polyethylene spheres, 35 parts by volume larger refractory particles 36, and 35 parts by volume smaller refractory particles 38.

Particles 38 and spheres 42 pack into spaces between larger particles 36 so that the overall coating 32 is relatively dense. In spite of the dense packing, coating 32 includes a network of interstitial pores 44. Pores 44 are interconnected and provide gas flow paths through the coating 32. However, pores 44 are relatively small so that gas diffusion therethrough is relatively low. Thus, coating 32 as applied is characterized by a reduced or relatively low gas permeability.

The lost foam casting process, and the effect upon coating 32, is illustrated in FIG. 3. Heat radiated from melt front 30 vaporizes the polystyrene 34 that forms pattern 10. The polystyrene may form a transient liquid phase prior to vaporization. Because the melt temperature greatly exceeds the polystyrene decomposition temperature, polystyrene 34 liquifies and vaporizes significantly in advance of melt front 30 so that a space 46 is formed therebetween. Space 46 is occupied by hot polystyrene decomposition vapors. Because of the relatively low permeability of coating 32 as applied, vapors build up in space 46 and pneumatically slow the advance of melt front 30, thereby slowing the rate at which melt 26 consumes and fills pattern 10. This slower filling reduces turbulence in melt 26 that would otherwise entrap vapors, and even prevaporized polystyrene, thereby creating pores in the casting. Front 30 is continually advancing as the result of hydrostatic pressure from melt 26. Thus, if the vapors are not eventually exhausted, they become engulfed by melt front 30.

The refractory particles 36 and 38 that form the majority of coating 32 have relatively low thermal conductivity. This low conductivity, together with the relatively small particle size and the dense packing produced by the manner in which coating 32 is applied, retards heat flow from melt 26 into mold 18, thereby permitting the melt to be poured at a lower temperature and yet consume the entire pattern. Although polyethylene particles 42 may enhance the thermal insulative properties of coating 32, the principal purpose of particles 42 relates to coating permeability. The interstitial arrangement of particles 42 among refractory particles 36 and 38 results in thermal insulation of the polymeric particles by the refractory particles. That is, refractory particles 36 and 38 not only insulate the melt 26 from mold 18, but also insulate particles 42 from melt 26. Outer particles more remote from polystyrene 34 are better insulated. This thermal insulation delays vaporization of the polyethylene particles 42 during casting, thereby maintaining low permeability to pattern decomposition vapors for a time suitable to reduce turbulence in melt 26. Furthermore, the slow heat flow through coating 32 is believed to first melt polyethylene particles 42, whereupon the resulting liquid (not shown) flows into interstitial pores 44 and thus close the pores to vapor diffusion through coating 32, thereby aiding to slow melt front 30 to reduce turbulence. Eventually, temperatures in coating 32 become sufficient to vaporize the polyethylene. The loss of polyethylene particles 42 produces relatively large pores 48 in the residual refractory coating 50 that enhances vapor flow through the coating into mold 18. Thus, polyethylene vaporization during casting results in a residual coating 50 characterized by a relatively high vapor permeability. As can be seen in FIG. 3, it is believed that particles 42 are vaporized in advance of melt front 30, but significantly behind polystyrene 34. Thus, venting occurs significantly in advance of melt front 30 to allow the melt front to steadily advance without engulfing vapors.

Eventually, polystyrene 34 is completely vaporized and pattern 10 is replaced by metal 26, as illustrated in FIG. 4. At this time, the polyethylene particles 42 are also completely vaporized, leaving a relatively porous residual refractory coating 50 that is readily cleaned from the casting by a pressurized water stream or other suitable technique. In addition to reducing metal porosity, the coating of this invention also produces an acceptable surface finish on the casting.

Although this invention has been described in terms of a preferred coating comprising particular refractory particles and a particular vaporizable particle, it is apparent that other materials may be suitably substituted. Also, in the described embodiment for casting aluminum alloys, a principal purpose of the coating is to prevent premature melt solidification. The coating is also suitable for lost foam casting of other metals, including iron. Because of higher casting temperatures for iron in comparison to aluminum alloy, it is believed that the polystyrene pattern vaporizes substantially further in advance of the metal. Thus, a thicker coating may be desirable to restrain the mold from collapsing after pattern vaporization and before melt replacement.

Although this invention has been described in terms of certain embodiments thereof, it is not intended to be limited to the above description but rather only to the extent set forth in the claims that follow.

The embodiments of the invention in which an exclusive property or privilege is claimed are defined as follows:

1. A coated pattern for casting reduced porosity metal by a lost foam process comprising a consumable pattern adapted to be decomposed and duplicated by molten metal to form a casting, said pattern decomposition forming vapors that produce pores in the casting when entrapped in the metal, and a coating applied to the pattern and formed of a predominantly refractory particulate matrix and polymeric particles vaporizable at metal casting temperatures, said polymeric particles being distributed within the matrix in a manner suitable to delay vaporization thereof as the result of heat from pattern-duplicating molten metal during casting, said coating with said polymeric particles having a relatively low permeability to pattern decomposition vapors effective to reduce turbulence in the molten metal during casting, but forming a residual coating upon vaporization of said polymeric particles wherethrough vapors readily vent to avoid entrapment within the metal.

2. A coated pattern for casting reduced porosity metal by a lost foam process comprising a consumable pattern formed of a material vaporizable at metal casting temperatures and suitably sized and shaped for duplication by molten metal to form a casting, said pattern being adapted to be progressively vaporized and replaced by molten metal during casting, whereupon pattern decomposition vapors that are entrapped in the metal form pores in the casting, and a coating applied to the pattern surface and to thermally insulate pattern replacement molten metal during casting to prevent premature solidification, said coating comprising thermally insulative, refractory particles and vaporizable polymeric particles, said polymeric particles being interstitially distributed among the refractory particles such that the refractory particles thermally insulate the polymeric particles from heat from pattern replacement molten metal during casting to delay vaporization thereof, said coating having initially a relatively low permeability to pattern decomposition vapors and developing a relatively high permeability to pattern decomposition vapors upon vaporization of the polymeric particles, whereby during casting vaporization of the polymeric particles is suitably delayed to cause pattern decomposition vapors to build up and slow metal replacement of the pattern to reduce vapor entrapment in the metal, said polymeric particles thereafter vaporizing to allow pattern decomposition vapors to vent through the coating to complete pattern replacement while avoiding vapor entrapment.

3. A singly coated pattern for casting reduced porosity metal by a lost foam process comprising a low density polystyrene pattern suitably sized and shaped for duplication by metal to form a desired casting, said pattern being adapted to be embedded in a suitable loose sand mold such that an embedded surface thereof faces the mold and to be progressively vaporized and replaced by molten metal during casting, whereupon polystyrene decomposition vapors require venting into the mold to avoid entrapment in the metal that forms pores in the casting, and a coating applied onto the embedded pattern surface to thermally insulate molten metal during casting to prevent premature solidification, said coating being formed predominantly of refractory particles characterized by relatively low thermal conductivity, said coating comprising polyethylene particles and a network of interstitial pores suitable for conveying low levels of gas therethrough, said polyethylene particles being suitable for liquifying and thereafter vaporizing when heated to metal casting temperatures and being interstitially arranged within the predominant refractory particles so as to be suitably insulated from heat from pattern replacement molten metal during casting so as to delay vaporization of said polyethylene particles during casting to cause said polyethylene to liquify and flow into pores to inhibit the flow of polystyrene decomposition vapors therethrough, whereupon the vapors build up and slow pattern replacement by the metal to reduce vapor-entrapping, pore-forming turbulence, said interstitial polyethylene particles being adapted upon vaporization to form pores in the residual refractory coating that cooperate with said pore network to readily vent polystyrene decomposition vapors into the mold to avoid pore-forming entrapment in the metal.

4. A metal casting process adapted to duplicate a fugitive pattern in reduced porosity metal, said process comprising forming a pattern vaporizable at metal casting temperatures, said pattern being suitably sized and shaped for duplication by metal to form a casting, applying to the pattern a coating formed of a predominantly refractory matrix comprising polymeric particles vaporizable at metal casting temperatures, said coating having a relatively low gas permeability, but forming a residual coating having a relatively high gas permeability upon vaporization of said vaporizable particles, said vaporizable particles being distributed within the coating so as to be thermally insulated by the refractory matrix from metal during casting, surrounding the coated pattern with a suitable mold material, casting molten metal onto the pattern within the mold to vaporize and to duplicate the pattern with molten metal to form the casting, and vaporizing the vaporizable particles in the coating during said casting to produce a gas-permeable residual coating, said refractory matrix suitably delaying vaporization of said particles to allow pattern-derived vapors to reduce turbulence in the molten metal as the metal duplicates the pattern, but said residual coating allowing the vapors to vent through the coating into the mold to avoid entrapment within the metal.

5. A lost foam process for casting reduced porosity metal comprising forming a pattern of a material that decomposes at metal casting temperatures to form vapors, said pattern being adapted to be suitably replaced by molten metal to form a casting, coating the pattern with a layer adapted to thermally insulate pattern-replacement molten metal during casting to prevent premature solidification, said layer comprising thermally insulative refractory particles and vaporizable polymeric particles interstitially arranged among the refractory particles said layer being initially characterized by a relatively low permeability to pattern decomposition vapors, surrounding the coated pattern with a suitable mold material, contacting the pattern in the mold with molten metal such that the metal decomposes the pattern material and thereafter flows to replace the pattern to form the casting, whereupon pattern decomposition forms vapors that produce pores in the casting if entrapped in the metal, and vaporizing the vaporizable particles within the coating layer by heat from the molten metal during pattern replacement, said vaporization being delayed by thermal insulation provided by the refractory particles for a time suitable to cause pattern decomposition vapors to build up and slow pattern replacement by the metal to reduce gas-entrapping turbulence, said vaporization thereafter producing a residual layer wherethrough pattern-decomposition vapors readily vent into the mold to avoid entrapment in the metal.

6. A lost foam process for casting reduced porosity metal comprising forming a low density polystyrene pattern suitably sized and shaped to form a desired casting and adapted to be progressively vaporized and replaced by molten metal during casting, whereupon polystyrene decomposition vapors that become entrapped in the metal form pores in the casting, transiently dipping the pattern into an aqueous slurry comprising a major portion of water-insoluble refractory particles, a minor portion of water-insoluble polyethylene particles, and a suitable bonding agent to apply a layer of slurry material onto a surface of the pattern, drying the slurry layer on the pattern to bond said particles to form a coating comprising interstitial pores suitable for conveying gas therethrough, embedding the coated pattern in a mold formed of unbonded sand such that said coated surface is adjacent the sand, contacting the embedded pattern with molten metal to progressively decompose the polystyrene and to replace the pattern with the metal to form the casting, and liquifying the polyethylene particles by heat from molten metal during pattern replacement to form a liquid phase that flows into pores within the coating to inhibit venting of polystyrene decomposition vapors therethrough, whereupon the vapors build up and slow pattern replacement by the metal to reduce pore-forming, vapor-entrapping turbulence therein, and thereafter vaporizing the polyethylene by heat from the molten metal during pattern replacement, said vaporization opening the pores within the residual refractory coating and said liquification and vaporization creating additional pores within the residual coating that enhance gas flow therethrough, whereupon polystyrene decomposition vapors readily vent through the residual coating into the sand mold to avoid pore-forming vapor entrapment in the metal.

* * * * *